US009126777B2

(12) United States Patent
Shimizu et al.

(10) Patent No.: US 9,126,777 B2
(45) Date of Patent: Sep. 8, 2015

(54) SHEET FEEDING MECHANISM AND IMAGE FORMING APPARATUS

(71) Applicants: Yoshikazu Shimizu, Nagoya (JP); Masafumi Inoue, Tajimi (JP)

(72) Inventors: Yoshikazu Shimizu, Nagoya (JP); Masafumi Inoue, Tajimi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 81 days.

(21) Appl. No.: 14/033,561

(22) Filed: Sep. 23, 2013

(65) Prior Publication Data

US 2014/0084537 A1 Mar. 27, 2014

(30) Foreign Application Priority Data

Sep. 26, 2012 (JP) ..... 2012-212846

(51) Int. Cl.
*B65H 7/02* (2006.01)
*B65H 5/00* (2006.01)
*B65H 5/06* (2006.01)

(52) U.S. Cl.
CPC ..... *B65H 5/00* (2013.01); *B65H 5/062* (2013.01); *B65H 7/02* (2013.01); *B65H 2402/31* (2013.01); *B65H 2404/6111* (2013.01); *B65H 2511/212* (2013.01); *B65H 2553/25* (2013.01); *B65H 2553/612* (2013.01); *B65H 2553/80* (2013.01); *B65H 2701/1311* (2013.01)

(58) Field of Classification Search
CPC ..... B65H 2553/25; B65H 2553/612; B65H 2553/80
USPC ..... 271/265.01, 272
See application file for complete search history.

(56) References Cited

U.S. PATENT DOCUMENTS

| | | | | |
|---|---|---|---|---|
| 7,644,921 | B2 | 1/2010 | Hattori | |
| 8,388,247 | B2 | 3/2013 | Ichikawa | |
| 2003/0080494 | A1 * | 5/2003 | Abe et al. | 271/121 |
| 2005/0017441 | A1 * | 1/2005 | Sugiyama | 271/264 |
| 2008/0219732 | A1 | 9/2008 | Hattori | |
| 2009/0180793 | A1 * | 7/2009 | Fujino | 399/68 |
| 2009/0213391 | A1 | 8/2009 | Ichikawa | |

FOREIGN PATENT DOCUMENTS

| | | |
|---|---|---|
| JP | 55-060141 | 4/1980 |
| JP | 2008-058388 A | 3/2008 |
| JP | 2009-202964 A | 9/2009 |

* cited by examiner

*Primary Examiner* — Howard Sanders
(74) *Attorney, Agent, or Firm* — Banner & Witcoff, Ltd.

(57) ABSTRACT

A sheet feeding mechanism is configured to feed a sheet, which has an actuator having a contact member configured to contact a sheet being fed, and a shaft configured to support the contact member, the shaft having a first end and a second end in a longitudinal direction, a first supporting part configured to support a first end portion of the shaft, a second supporting part configured to support a second end portion of the shaft, a detection unit configured to detect a position of the contact member, and an elastic supporting member configured to holds the first end portion of the shaft such that the shaft is displaceable in a direction perpendicular to the longitudinal direction.

18 Claims, 10 Drawing Sheets

SHEET FEEDING MECHANISM AND IMAGE FORMING APPARATUS

CROSS-REFERENCE TO RELATED APPLICATION

This application claims priority under 35 U.S.C. §119 from Japanese Patent Application No. 2012-212846 filed on Sep. 26, 2012. The entire subject matter of the application is incorporated herein by reference.

BACKGROUND

1. Technical Field

Aspects of the invention relate to a sheet feeding mechanism and an image forming apparatus having such a sheet feeding mechanism.

2. Prior Art

Conventionally, an image forming apparatus having a rockable contacting member which rocks as it contacts the sheet, and an actuator having a shaft which supports such a contacting member. Typically, the elongated openings, in which both ends of the shaft are fitted, are formed at supporting parts to support the rocking shaft.

SUMMARY

According to the above-described configuration of the conventional art, the shaft is movable in a longer-radius direction of the elongated opening so that the contact member does not greatly interfere with the sheet.

However, in the above-described configuration, since the shaft is supported by the supporting parts such that both ends thereof are fitted in the elongated openings, it is difficult to maintain the shaft at a fixed position, and accordingly, it is difficult to maintain a position of the contact member, accurately.

On consideration of the above problem, aspects of the present invention provide an improved sheet feeding mechanism with which interference of the sheet with the contact member can be suppressed, while a positional accuracy of the contact member can be maintained.

According to aspects of the invention, there is provided a sheet feeding mechanism configured to feed a sheet, which has an actuator having a contact member configured to contact a sheet being fed, and a shaft configured to support the contact member such that the contact member is rotatable about the shaft, the shaft having a first end and a second end in a longitudinal direction, a first supporting part configured to support a first end portion of the shaft, a second supporting part configured to support a second end portion of the shaft, a detection unit configured to detect a position of the contact member, and an elastic supporting member configured to holds the first end portion of the shaft such that the shaft is displaceable in a direction perpendicular to the longitudinal direction.

BRIEF DESCRIPTION OF THE ACCOMPANYING DRAWINGS

DETAILED DESCRIPTION OF THE EMBODIMENT

Hereinafter, an exemplary embodiment according to aspects of the invention will be described. It is noted that concrete components and structures of the exemplary embodiment are not intended to limit the scope of the invention.

The exemplary embodiment shows the sheet feeding mechanism and an image forming apparatus employing such a sheet feeding mechanism to which the present invention is applied. Hereinafter, the exemplary embodiment will be described in detail with reference to the accompanying drawings.

1. General Description of Image Forming Apparatus

Figure 1:
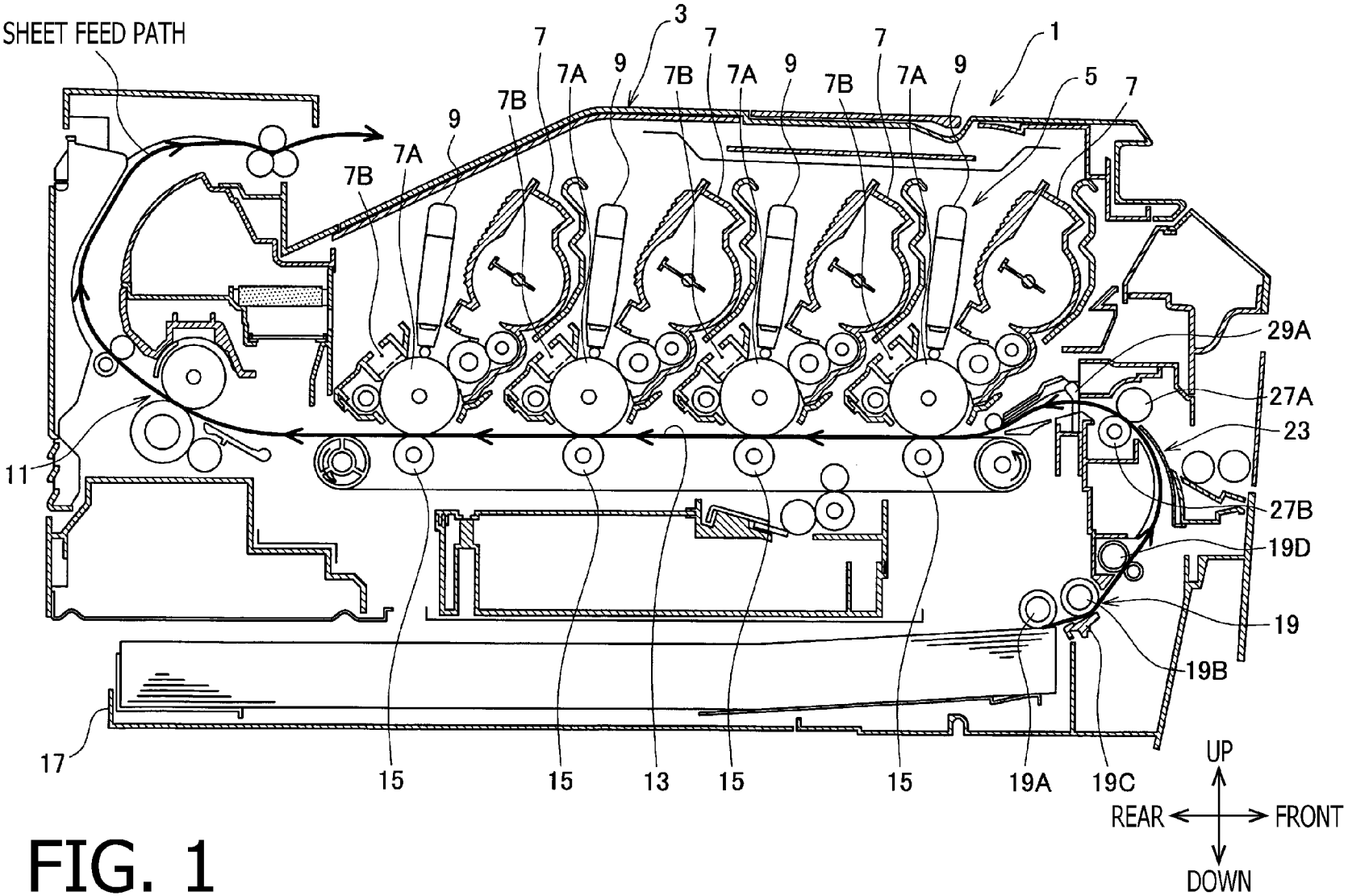
FIG. 1 is a cross-sectional side view of an image formation apparatus according to an embodiment of the invention.

An image forming apparatus 1 has a housing 3, in which an image forming unit 5 is accommodated as shown in FIG. 1. The image forming unit 5 is configured to form an image on a sheet such as a printing sheet in accordance with a well-known electrophotographic image forming process.

It is noted that the image forming unit 5 according to the embodiment is configured as a so-called direct tandem type image forming unit which is provided with a plurality of (e.g., four) process cartridges 7 arranged in a direction perpendicular to axes of photoconductive drums 7A (which will be described later).

Each process cartridge 7 is detachably coupled to a main body of the image forming apparatus 1. The plurality of process cartridges 7 have the substantially same structures, and only colors of developing agent (e.g., toner) accommodated in the plurality of process cartridges 7 are different. Specifically, each process cartridge 7 has a photoconductive drum 7A, a charger 3B and the like.

Figure 2:
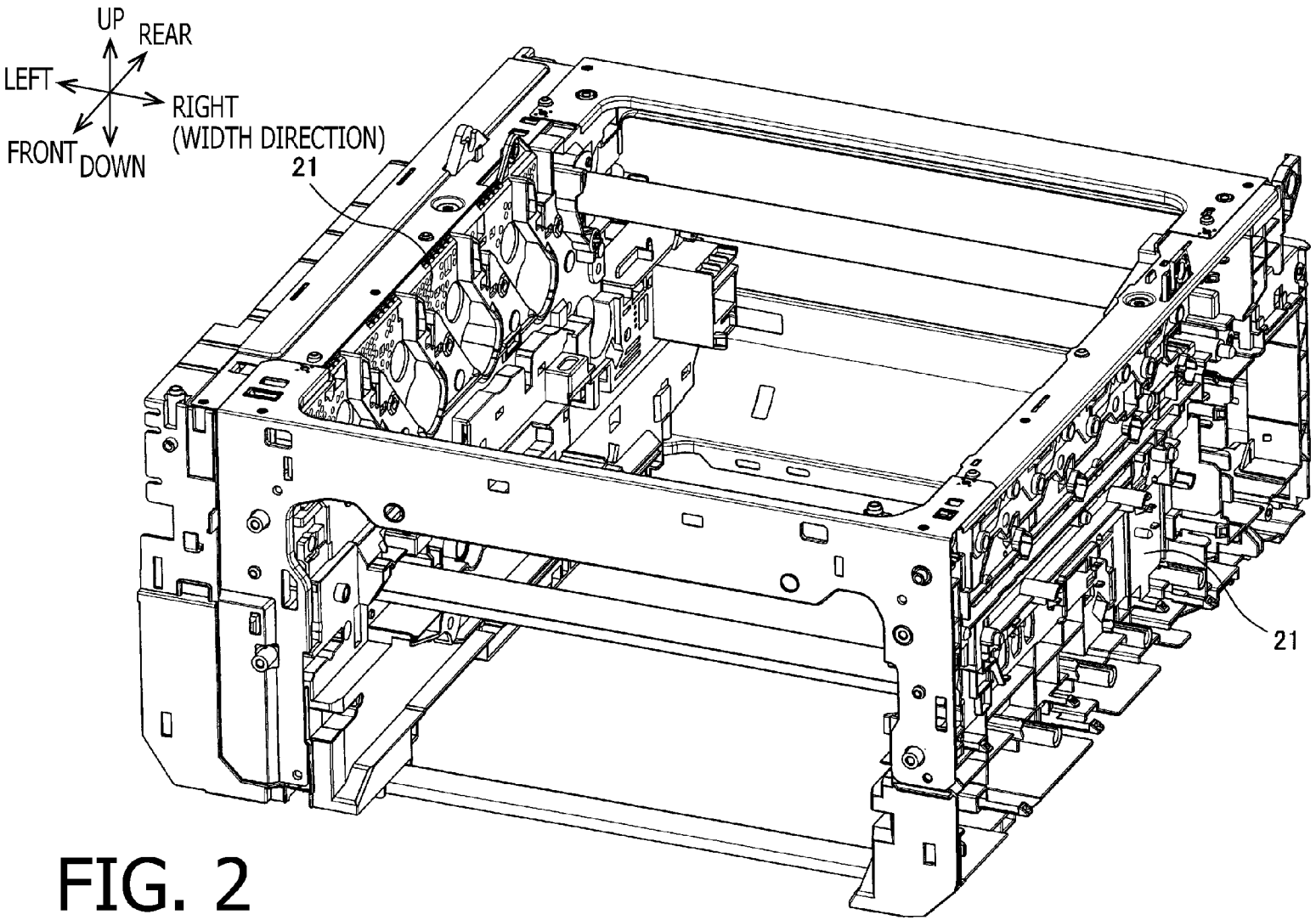
FIG. 2 is a perspective view of a main frame of the image forming apparatus according to aspects of the invention.

The main body of the image forming apparatus 1 includes the housing 3, a pair of main frames 21 and the like, which will not be taken apart by a user of the image forming apparatus 1. The pair of main frames 21 include plate-like members facing each other, in a width direction, with a space therebetween as shown in FIG. 2. The components of the image forming unit 5 such as the process cartridges 7 are coupled to the pair of main frames 21. In the description, the "width direction" refers to a direction parallel with the axes of the photoconductive drums 7A, as indicated in respective drawings.

On the plate-like members of the pair of main frames 21, a plurality of reinforcing walls protruding in the width direction therefrom are provided. Further, the pair of main frames 21 as well as the plurality of reinforcing walls are formed of resin. It is noted that the plate-like members of the pair of main frames 21 are imaginary planes defining substantially plate-like appearance of the pair of main frames 21.

The photoconductive drums 7A are configured to bear images formed by the developing agent (e.g., toner images), which are transferred to the sheet. The chargers 3B are used to charge the circumferential surfaces of the photoconductive drums 7A. Exposure units 9 cause the charged photoconductive drums 7A to be exposed to light based on image data so that electrostatic latent images are formed on the photoconductive drums 7A, respectively. Each of the photoconductive drums 7A is arranged such that the axis thereof is perpendicular to a sheet feeding direction, and the plurality of photoconductive drums 7A are arranged, in series, along a direction parallel to the sheet feed direction.

At positions opposite to the photoconductive drums 7A with a transfer belt 13 therebetween, transfer units 15 configured to cause the images formed by the developing agents (e.g., toner images) to be transferred onto the sheet. As is well known, the plurality of images formed by the developing agents having different colors respectively carried by the plurality of photoconductive drums 7A are transferred on the sheet fed by the transfer belt 13 in an overlapped manner so that image of respective color components are overlapped to form one color image. The transferred images formed by the developing agents are heated and fixed on the sheet by a fixing unit 11.

Below the transfer belt 13, a sheet supply tray 17 is provided. In the sheet supply tray 17, a plurality of sheets are placed in a stacked manner. The plurality of sheets accommodated in the sheet supply tray 17 are fed by a feeder mechanism 19 one by one. According to the exemplary embodiment, a sheet feeding mechanism 23 feeds the sheet supplied by the feeder mechanism 19 toward the image forming unit 5.

The feeder mechanism 19 includes a pickup roller 19A, a separation roller 19B and a separation pad 19C. The pickup roller 19A applies a feeding force to the sheet placed in the sheet supply tray 17. The separation roller 19B, in association with the separation pad 19C, separates one sheet from a plurality of overlapped sheets.

2. Sheet Feeding Mechanism

Figure 3:
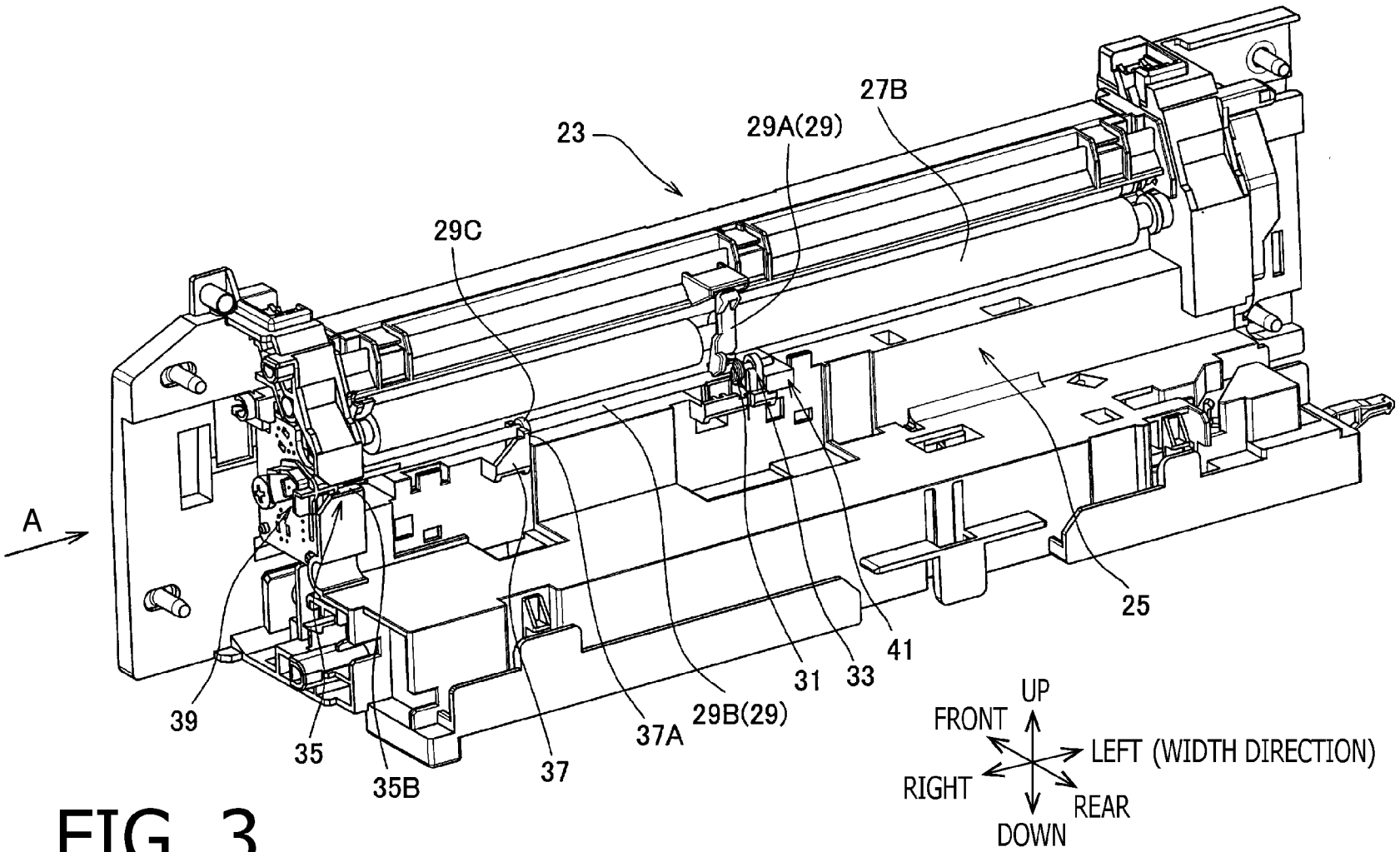
FIG. 3 is a perspective view of a sheet feeding unit according to the embodiment of the invention.

The sheet feeding mechanism 23 is provided to a sheet supply frame 25 as shown in FIG. 3. The sheet supply frame 25 is a beam-like member extending in the width direction between the pair of main frames 21. The sheet supply frame 25 is arranged on the front side of the pair of main frames 21 and secured thereto.

The sheet supply frame 25 rotatably supports a pair of rollers 27A and 27B which feed the sheet supplied by the feeder mechanism 19. According to the exemplary embodiment, the separation roller 19B of the feeder mechanism 19 is also coupled to the sheet supply frame 25.

The pair of rollers 27A and 27B also serves as register rollers which correct attitude (i.e., feeding direction) of the sheet in addition to a sheet feeding function. That is, the pair of rollers 27A and 27B tentatively pauses feeding of the sheet which is supplied by the feeder mechanism 19 to correct the orientation of the sheet. Thereafter, in accordance with a predetermined timing, the pair of rollers 27A and 27B restarts feeding the sheet to the image forming unit 5.

Figure 4:
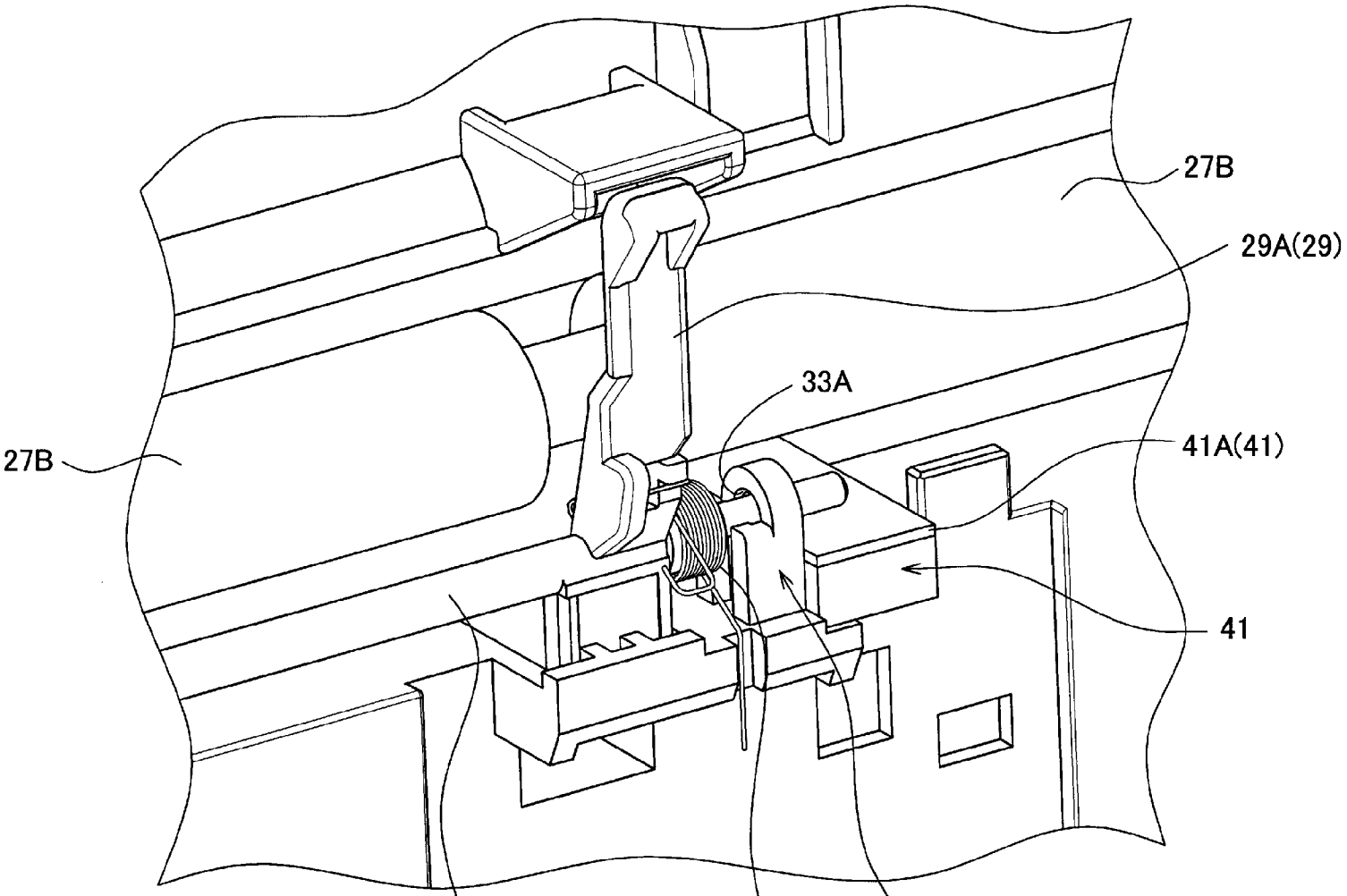
FIG. 4 is an enlarged perspective view showing a portion in the vicinity of the contact member.

On a downstream side, in the sheet feed direction, of the pair of rollers 27A and 27B, the actuator 29 is provided as shown in FIG. 4. The actuator 29 has at least a contact member 29A and a rocking shaft 29B.

The contact member 29A rocks as it contacts the sheet having been fed. The rocking shaft 29B rockably supports the contact member 29A. The spring 31 urges the actuator 29 to generate an elastic force F1. The elastic force F1 is a force which urges the contact member 29A to rockably displace in the upstream side, in the sheet feed direction.

Figure 5:
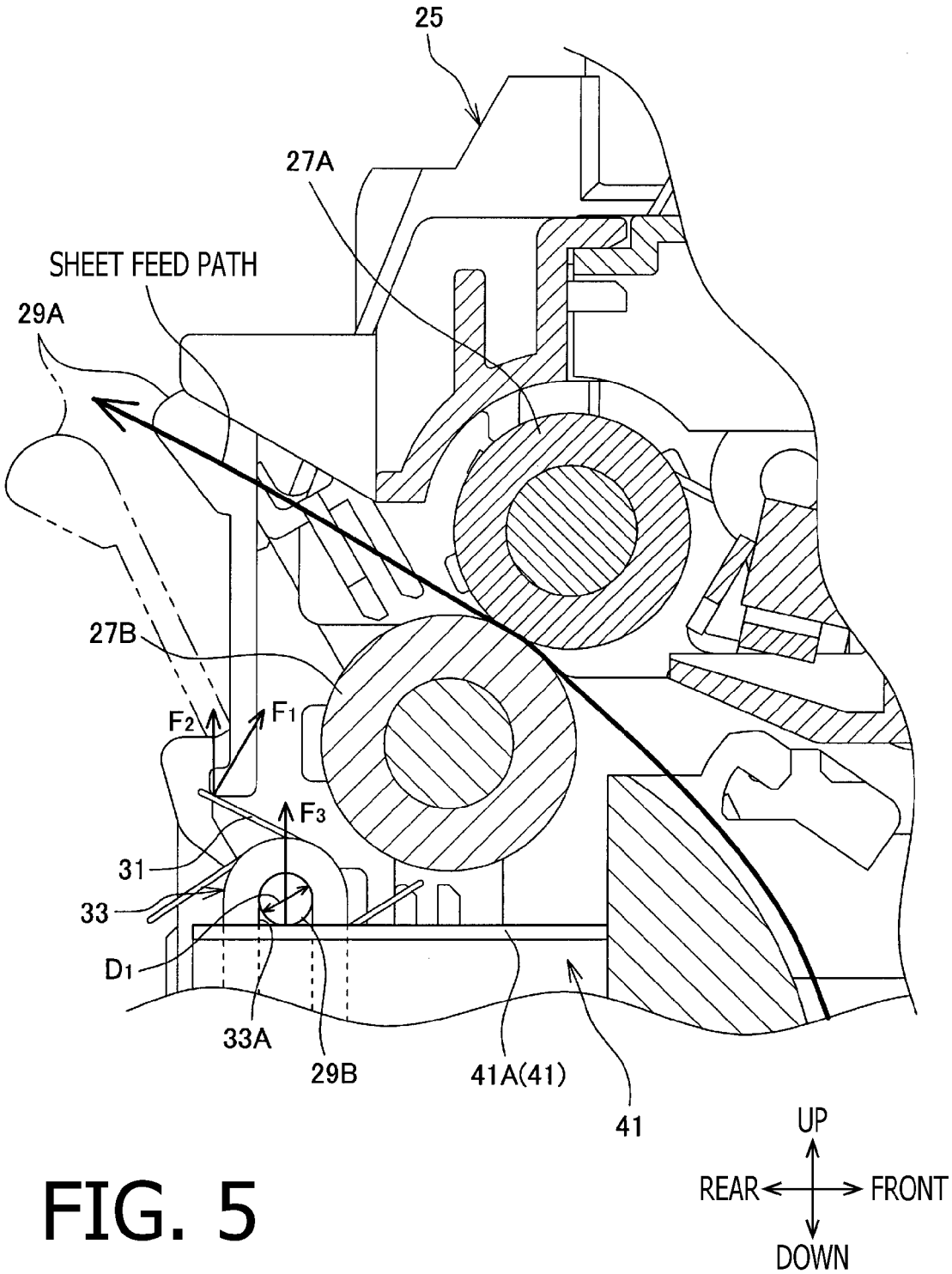
FIG. 5 is a partial cross-sectional view of the sheet feeding unit shown in FIG. 3.

Therefore, when the leading end of the sheet fed from the pair of rollers 27A and 27B hits the contact member 29A, the contact member 29A rockably displaces on the downstream side, in the sheet feed direction, as indicated by two-dotted lines in FIG. 5. When the trailing end of the sheet detached from the contact member 29A, the contact member 29A returns to be displaced in the upstream side by the elastic force F1 of the spring 31 as indicated by solid lines in FIG. 5.

The rocking shaft 29B is supported by a first supporting part 33, a second supporting part 35 and a third supporting part 37 as shown in FIG. 3. The first supporting part 33 supports a first longitudinal end (e.g., a left side end in FIG. 3) of the rocking shaft 29B. The second supporting part 35 supports a second longitudinal end (e.g., a right side end in FIG. 3) of the rocking shaft 29B.

According to the exemplary embodiment, the contact member 29A and the rocking shaft 29B are formed integrally. Therefore, the rocking shaft 29B rotates in mechanical association with the rocking movement of the contact member 29A. That is, the first supporting part 33, the second supporting part 35 and the third supporting part 37 serve as a bearing part which rotatably supports the rocking shaft 29B. Further, the first supporting part 33, the second supporting part 35 and the third supporting part 37 are integrally provided to the sheet supply frame 25.

A detecting unit 39 is configured to detect whether the contact member 29A is located at a position indicated by the slid lines in FIG. 5 or a position indicated by two-dotted lines. The detecting unit 39 is provided on the rocking shaft 29B on one longitudinal end side, closer to the second supporting part 35 that the first supporting part 33.

The detecting unit 39 includes a movable member 39A which rotates/rocks integrally with the rocking shaft 29B, and a sensor unit 39E having a light emitting device 39C and a light receiving device 39D. The movable member 39A is a C-shaped member provided at a longitudinal end portion of the rocking shaft 29B. According to the exemplary embodiment, the movable member 39A and the rocking shaft 29B are integrally formed of resin.

The light emitting device 39C and the light receiving device 39D are arranged to have a predetermined space therebetween. At a tip end of the movable member 39A, a light shielding part 39B is formed, which reciprocally moves between a position at which the light shielding part 39B is inserted in a light path from the light emitting device 39C to the light receiving device 39D, and another position at which the light shielding part does not shield the light path.

According to the exemplary embodiment, when the contact member 29A is located at a position indicated by the solid lines in FIG. 5, the light path is shielded by the light shielding part 39B, and a signal representing a shielded status is output from the detecting unit 39. When the contact member 29A is located at a position indicated by the two-dotted lines in FIG. 5, the light path is not shielded by the light shielding part 39B and the detecting unit 39 outputs a signal indicating a non-shielded status.

On the first longitudinal end side of the rocking shaft 29B, as shown in FIG. 3, an elastic supporting member 41 which is elastically deformable is provided. The elastic supporting member 41 holds the longitudinal end side of the rocking shaft 29B so that the rocking shaft 29B is displaceable in a direction perpendicular to the longitudinal direction. It is noted that, according to the exemplary embodiment, the elastic supporting member 41 is made of porous elastic member such as sponge.

It is noted that the direction perpendicular to the longitudinal direction, or the direction in which the rocking shaft 29B is displaceable is a direction intersecting the surface of the sheet being fed. According to the exemplary embodiment, the displaceable direction is substantially parallel with the up-and-down direction.

At a portion of the elastic supporting member 41 which contacts the rocking shaft 29B, a coating layer 41A made of resin such as a PET (polyethylene terephthalate) film is provided. Further, at least a portion of the rocking shaft 29B which contacts the elastic supporting member 41, that is the first longitudinal end portion of the rocking shaft 29B is formed to has a diameter D1 which is smaller than a diameter D2 at the second longitudinal end end portion of the rocking shaft 29B.

It is noted that the diameter of the rocking shaft 29B is defined as follows. When a cross section of the rocking shaft 29B is a circle, the diameter of the rocking shaft 29B is equal to the diameter of the circle. When the cross section of the rocking shaft 29B is not a circle (e.g., an oval), the diameter D1 is defined as an outer size of a portion which contacts the elastic supporting member 41. The diameter D2 of the rocking shaft 29B when the cross section is not a circle is an outer size of the other end portion in the direction parallel with the diameter D1.

A first shaft hole 33A formed on the first supporting part 33 is an elongated hold as shown in FIG. 5. Therefore, the first longitudinal end side of the rocking shaft 29B can be displaced within the elongated hole 33A in the longer diameter direction. The elastic supporting member 41 applies an elastic force F3 which urges the rocking shaft 29B to press-contact an inner surface of the first shaft hole 33A.

More specifically, the elastic supporting member 41 urges the rocking shaft 29B so as to press-contact the inner circumferential surface of one end side of the first elongated hole 33A. According to the exemplary embodiment, the spring 31 also elastic force F2 which urges the rocking shaft 29B to the inner circumferential surface of the first shaft hole 33A. The elastic force F2 is a component parallel with the longer diameter direction of the elastic force F1 that displaces the contact member 29A.

Figure 6:
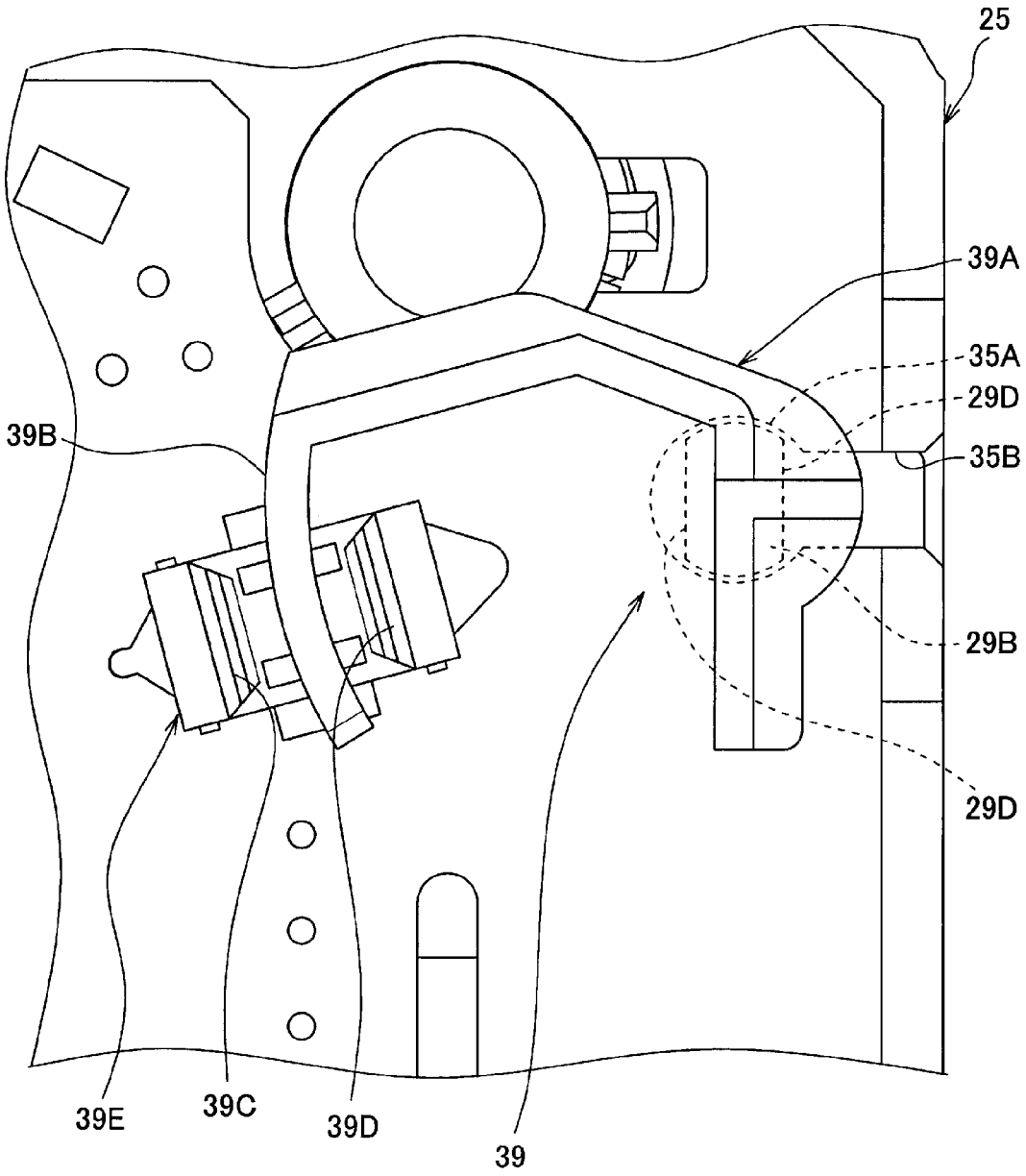
FIG. 6 is part of the sheet feed unit viewed along an arrow A in FIG. 3.

The second shaft hole 35A formed on the second supporting part 35 is formed to be a circular hole as shown in FIG. 6. Accordingly, the longitudinal end of the rocking shaft 29B inserted in the second shaft hole 35A hardly displaces in a direction of the diameter of the second shaft hole 35A. That is, a clearance between the first shaft hole 33A and the rocking shaft 29B is larger than a clearance between the second shaft hole 35A and the rocking shaft 29B.

On the second supporting part 35, an open part 35B, which makes a part of the second shaft hole 35A opened so that the inner surface of the second shaft hole 35A becomes C-shaped. On portion at the second longitudinal end of the rocking shaft 29B, corresponding to the second shaft hole 35A, a pair of planer parts which are parallel to each other is formed.

Therefore, when the second longitudinal end side portion of the rocking shaft 29B is coupled to the second supporting part 35, a worker can insert the second end portion of the rocking shaft 29B in the second shaft hole 35A through the opening 35B with making the pair of planar parts 29D in parallel with the opening 35B.

According to the exemplary embodiment, the first shaft hole 33A and the second shaft hole 35A are through holes, in which the rocking shaft 29B penetrates. The elastic supporting member 41, the first supporting part 33, the spring 33 and the contact member 29A are arranged from the first side end (i.e., the left end) toward the second side end in this order.

The third supporting part 37 supports the rocking shaft 29B at a position between the second supporting part 35 and the contact member 29A. The third supporting part 37 is provided with a restriction member 37A which is configured to restrict displacement of the rocking shaft 29B in its longitudinal direction.

Figure 7:
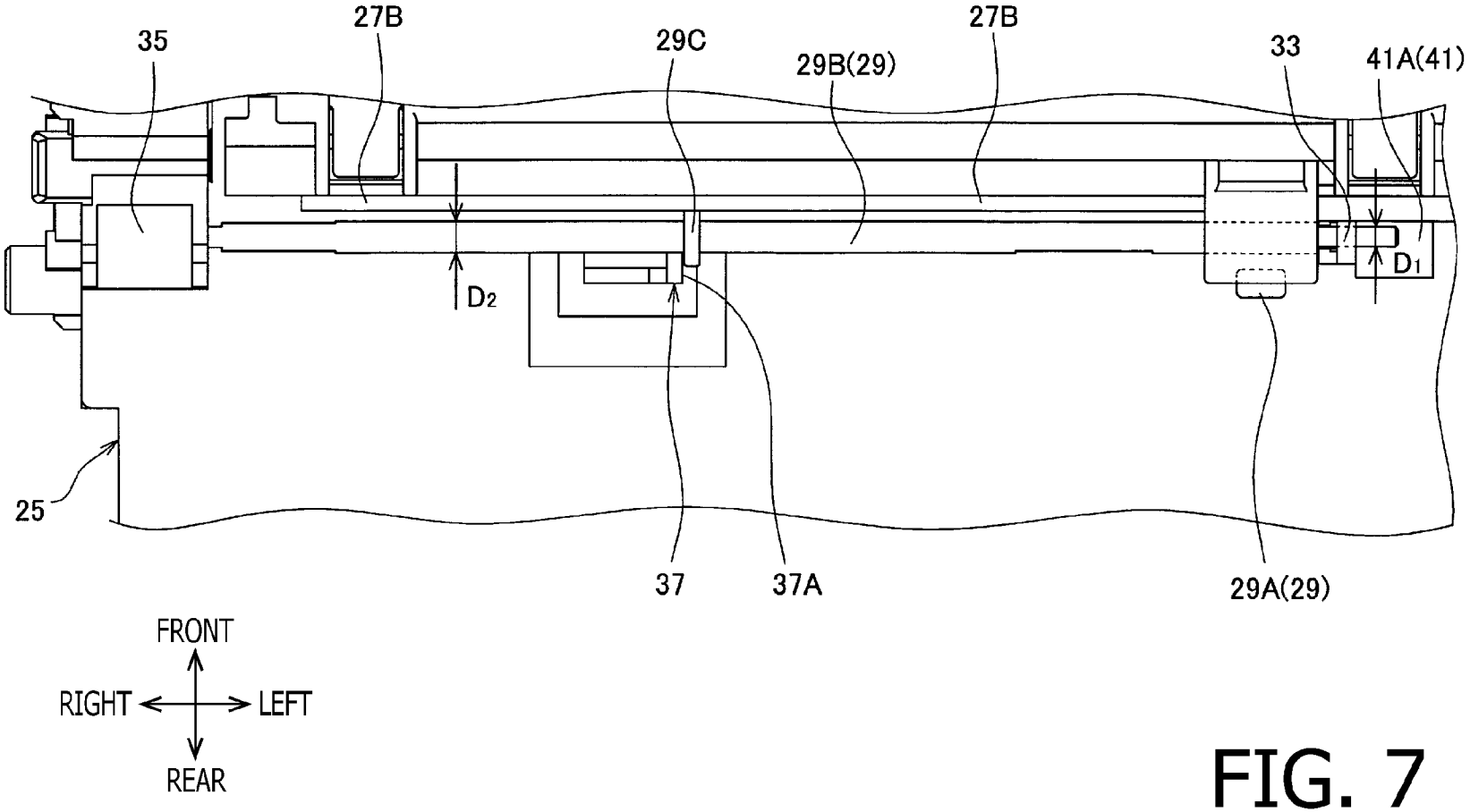
FIG. 7 is a plan view of the actuator and components around the actuator.
Figure 8:
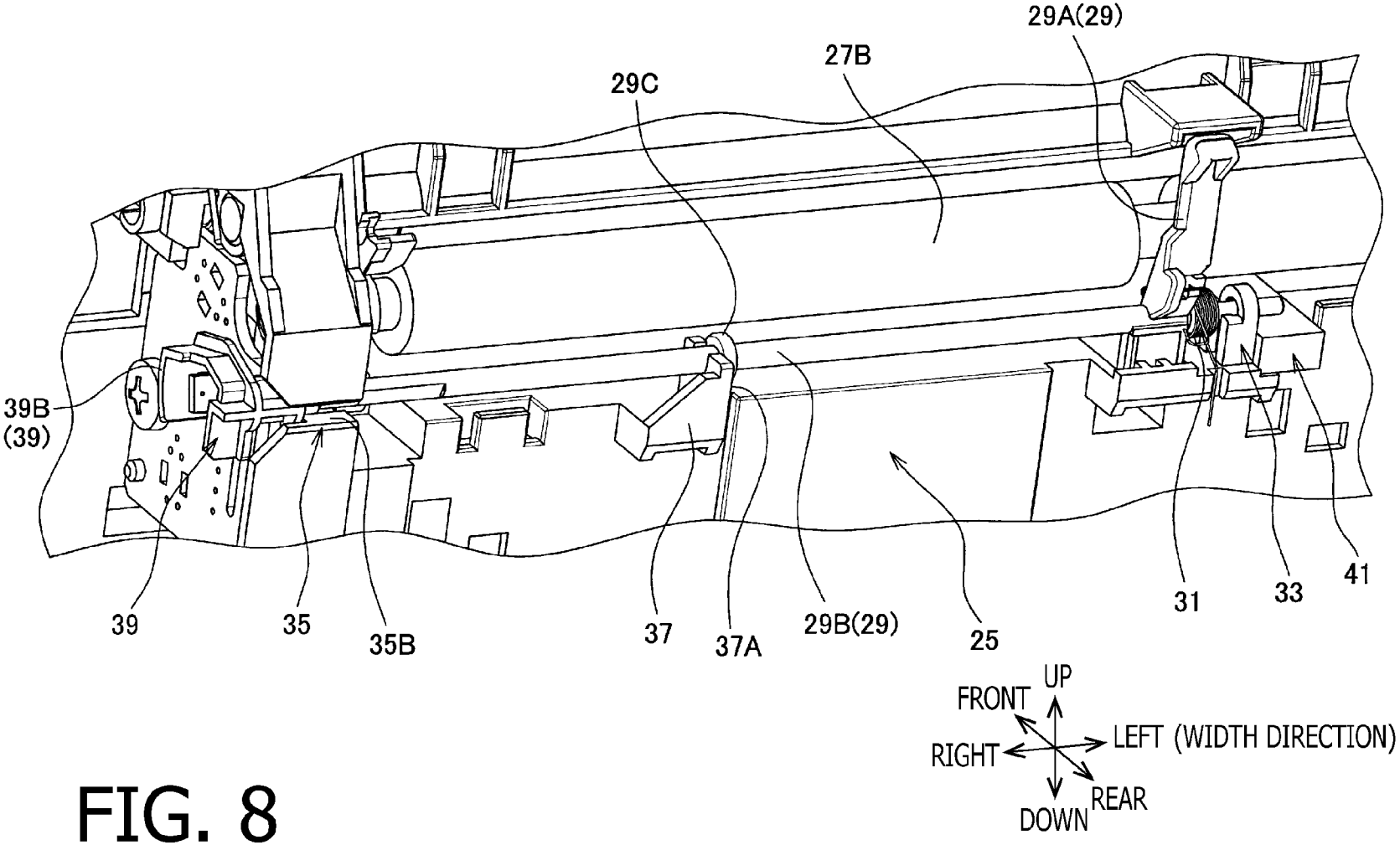
FIG. 8 is a partial perspective view showing an arrangement of a contact member, a spring, a first supporting member and an elastic supporting member.

Specifically, as shown in FIG. 7, on the rocking shaft 29B, at a position on the contact member 29A side with respect to the third supporting part 37, a projection 29C projecting outwardly from the circumferential surface of the rocking shaft 29B is integrally provided. Further, the restriction member 37A is provided on the contact member 29A side of the third supporting part 37.

The projection 29C is a flange-like projection protruded outwardly from the circumferential surface of the rocking shaft 29B, and formed integrally with the rocking shaft 29B. The restriction member 37A is a wall member having a slidable surface which slidably contacts the projection 29C.

3. Characteristic Features

Figure 9:
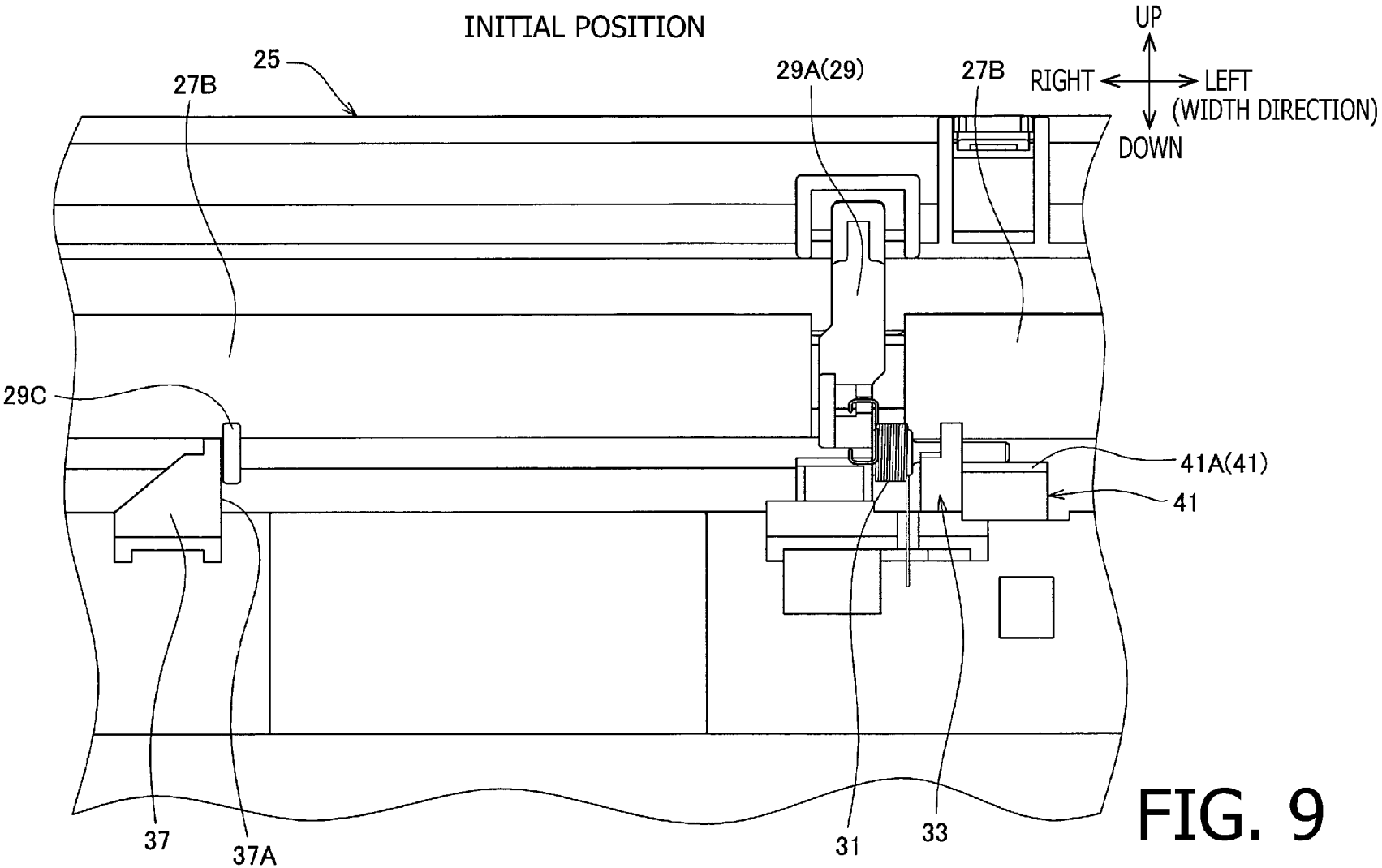
FIGS. 9 and 10 are views illustrating characteristic features of the embodiment.

According to the exemplary embodiment, when an external force is not applied to the contact member 29A, the first side end of the rocking shaft 29B is located on one end side of the first shaft hole 33A, that is, on the upper end side of the first shaft hole 33A as shown in FIGS. 5 and 9.

Figure 10:
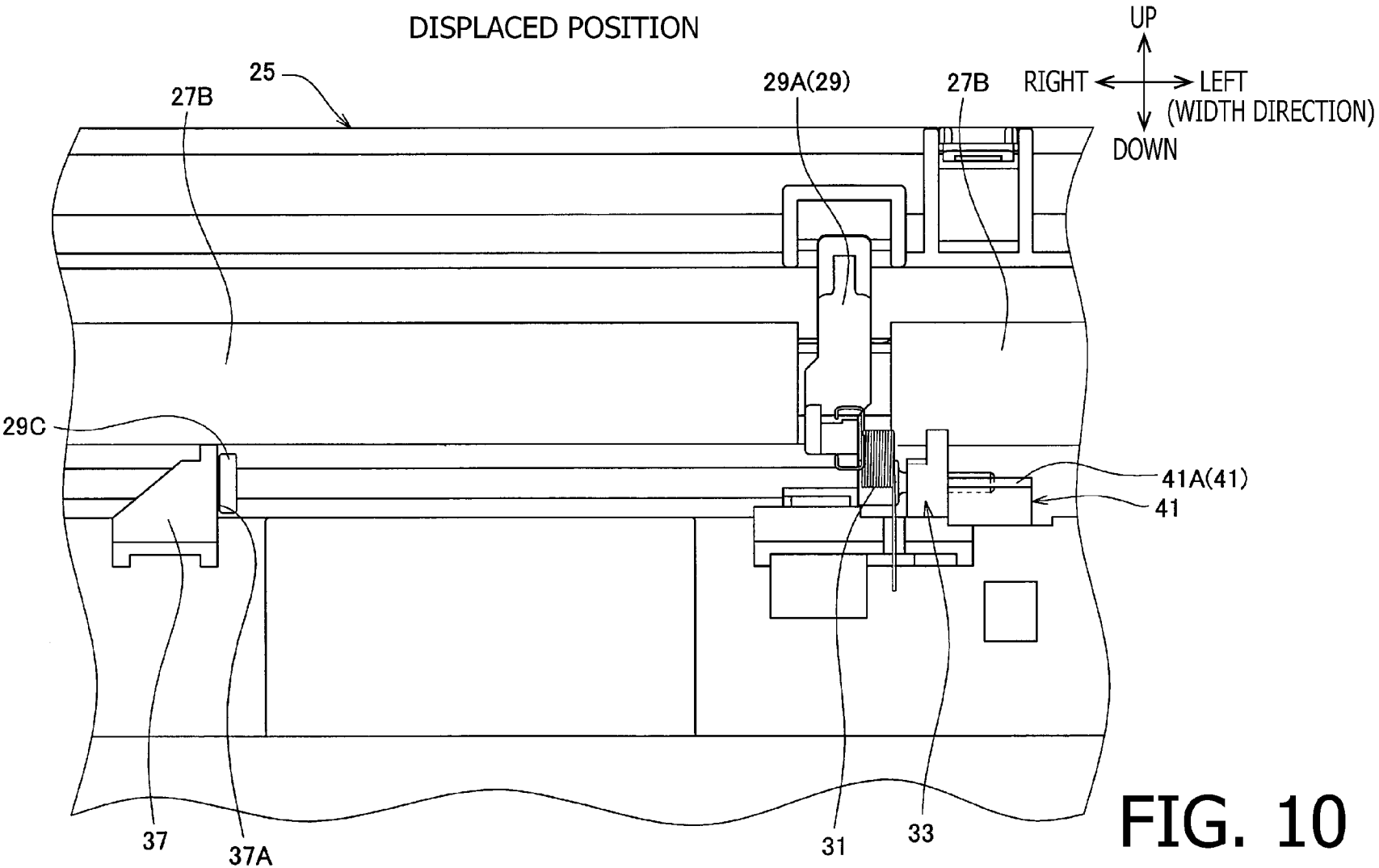

When, for example, a jammed sheet is to be removed, and the jammed sheet interferes with the contact member 29A, a relatively large force is applied to the elastic supporting member 41. In such a case, according to the exemplary embodiment, since the elastic supporting member 41 is elastically deformable, the contact member 29A displaces toward the other end side of the first shaft hole 33A, that is, on the lower end side of the shaft hole 33A as the elastic member 41 elastically deforms, as shown in FIG. 10.

As above, when the jammed sheet interferes with the contact member 29A, the contacting member 20A can be retracted from the sheet. Therefore, it is possible to avoid a condition that the jammed sheet interferes with the contacting member with a relatively large force applied therebetween.

Further, since the elastic supporting member 41 elastically deforms, when a relatively large force is not applied to the contact member 29A (e.g., when the sheet and the contact member 29A do not interfere with each other), the elastic supporting member 41 deforms little. Therefore, in such a case (e.g., when the sheet and the contact member 29A do not interfere with each other), the rocking shaft 29B is held at a constant position by the elastic supporting member 41.

According to the above-described configuration of the exemplary embodiment, it is possible to suppress interference between the sheet and contact member 29A with a relatively large force, while a positional accuracy of the contact member 29A can be maintained.

According to the exemplary embodiment, a portion where the elastic supporting member 41 contacts the rocking shaft 29B, a coating layer 41A is formed. With this configuration, it is possible to reduce a frictional resistance at a portion where the rocking shaft 29B slidably contacts the elastic supporting member 41. Further, it is possible that the rocking shaft 29B can be supported with use of elasticity of the coating layer 41A.

Further, since the elastic supporting member 41 is coated by the coating layer 41A which is made of resin, the elastic supporting member 41 can be protected.

According to the exemplary embodiment, the detection unit 39 is provide at a position closer to the second supporting part 35 than the first supporting part 33, and the third supporting part 37 is formed between the second supporting part 35 and the contact member 29A.

With this configuration, when the sheet and the contact member 29A interfere with each other, sagging and deformation of the rocking shaft 29B can be well suppressed. Therefore, malfunctions of the detecting unit 39 can be prevented.

Further, according to the exemplary embodiment, the restriction member 37A, which restricts displacement of the rocking shaft 29B in the longitudinal direction, is provided to the third supporting part 37. This configuration also suppresses malfunction of the detecting unit 39.

When the diameter of the rocking shaft 29B is relatively large, even if the elastic supporting member 41 largely deforms, the contact member 29A may not be retracted sufficiently to reduce the interference between the sheet and the contact member 29A.

According to the exemplary embodiment, the diameter D1 of the first end portion of the rocking shaft 29B is smaller than the diameter D2 of the second end portion thereof. With this configuration, when the elastic supporting member 41 elastically deforms, the first end portion of the rocking shaft 29B can be displaced sufficiently. Therefore, the contact member 29A can be retracted by a sufficient amount, and it is possible to suppress the interference between the sheet and the contact member 29A with the relatively large force.

According to the exemplary embodiment, the sprint 31 is provided. The spring 31 applies an elastic force to rockably displace the contact member 29A toward the upstream direction, in the sheet feeding direction, while applies an elastic force to urge the rocking shaft 29B to the inner circumferential surface of the first shaft hole 33A. With this configuration, the rocking shaft 29B can be held at the constant position.

4. Modifications

In the above-described exemplary embodiment, the first side portion of the rocking shaft is configured to be largely displaceable with respect the first shaft hole 33A formed on the first supporting part 33, while the first side portion of the rocking shaft 29B is directly held by the elastic supporting member 41. This configuration is only an exemplary one and the invention need not be limited to such a configuration.

For example, the first shaft hole 33A may be formed as a circular hole and the first supporting part 33 is supported by the elastic supporting member 41 entirely so that the first side portion of the rocking shaft 29B is supported by the elastic supporting member 41 indirectly.

In the exemplary embodiment, the first shaft hole 33A is formed as an elongated hole, while the second shaft hole 35A is formed as a circular hole. The invention need not be limited to such a configuration, and the first shaft hole 33A may be formed as a circular hole, for example. In such a case, however, a further modification may be necessary to widen a space between the first shaft hole 33A and the rocking shaft 29B than a space between the second shaft hole 35A and the rocking shaft 29B.

In the exemplary embodiment, the elastic supporting member 41 is formed of porous member such as sponge. The invention need not be limited to such a configuration, and the elastic supporting member 41 may be made of other elastic members such as rubber or spring. Alternatively, the sprint 31 may be configured to also serve as the elastic supporting member 41.

In the exemplary embodiment, a portion of the elastic supporting member 41, which contacts the rocking shaft 29B, is coated with the coating layer 41A. It is noted that the invention need not be limited to such a configuration, and the coating layer 41A may not be formed.

In the exemplary embodiment, the third supporting part 37 and the restriction member 37A are provided. However, the invention need not be limited to such a configuration, and one of both of the third supporting part 37 and the restriction member 37A may not be provided.

In the exemplary embodiment, the rocking shaft 29B penetrates the first supporting part 33 and the second supporting part 35. The invention need not be limited to such a configuration, and one end of the first shaft hole 33A or the second shaft hole 35A may be closed.

In the exemplary embodiment, the first supporting part 33 is formed at a substantially central port of the longitudinal length of the sheet supply frame 25. The invention need not be limited to such a configuration, and the first supporting part 33 may be provided at a side end portion of the sheet supply frame 25. In such a case, the position of the contact member 29A may be either the central part of the sheet supplying frame 25 or side end portion thereof.

In the exemplary embodiment, the spring 31 applies the elastic force F2 which urges the rocking shaft 29B to the inner circumferential surface of the first shaft hole 33A. The invention need not be limited to such a configuration.

In the exemplary embodiment, the elastic supporting member 41, the first supporting part 33, the sprint 31 and the contact member 29A are arranged from the left side (i.e., the first side) in this order. However, the invention need not be limited to such a configuration.

In the exemplary embodiment, the detecting unit 39 is an optical sensor having the light emitting device 39C and the light receiving device 39D. However, the invention need not be limited to such a configuration, and a contact sensor unit having a limit switch and the like, or a non-contact proximity sensor unit making use of change of magnetic field may be employed.

In the exemplary embodiment, the present invention is applied to the sheet feeding mechanism which is configured such that the sheet fed by the feeding mechanism 19 is introduced toward the image forming unit 5. However, the invention need not be limited to such a configuration. The present invention may be applied to an ADF (automatic document feeder) of an image scanning apparatus.

In the exemplary embodiment, the image forming apparatus is employing a direct transfer method so that the developing agent is directly transferred onto the sheet. However, the invention need not be limited to such a configuration, and the invention can be applied to an image forming apparatus employing a so-called intermediate transfer system in which the developing agent is once transferred to a transfer belt and then transferred to the sheet, or an image forming apparatus employing an inkjet image forming device.

It should be noted that the present invention need not be limited to the configurations of the exemplary embodiment and can be modified in various ways without departing from the scope of the invention.

What is claimed is:

1. A sheet feeding mechanism configured to feed a sheet along a sheet feed path, the sheet feeding mechanism comprising:

an actuator having a contact member configured to contact a sheet within a contact area of the sheet feed path, and a shaft configured to support the contact member such that the contact member is rotatable about the shaft, the shaft having a first end and a second end in a longitudinal direction;

a first supporting part configured to support a first end portion of the shaft, wherein the first supporting part has a first shaft hole extending in a direction such that the first end of the shaft can move closer to or farther away from the sheet feed path, the first shaft hole having an end portion on a side closer to the sheet feed path;

a second supporting part configured to support a second end portion of the shaft, wherein the second supporting part has a second shaft hole in which the shaft can be fitted;

a detection unit configured to detect a position of the contact member; and an elastic supporting member configured to hold the first end portion of the shaft such that the shaft is displaceable in a direction perpendicular to the longitudinal direction;

wherein the elastic supporting member biases the first end portion of the shaft in a direction toward the contact area of the sheet feed path to contact the end portion of the first shaft hole.

2. The sheet feeding mechanism according to claim 1, wherein:

the first shaft hole is formed to be an elongated hole; and the second shaft hole is formed to be a circular hole.

3. The sheet feeding mechanism according to claim 1, wherein the elastic supporting member is made of porous material.

4. The sheet feeding mechanism according to claim 1, wherein a portion of the elastic supporting member which contacts the shaft is provided with a coating layer formed of resin.

5. The sheet feeding mechanism according to claim 1, wherein:

the detection unit is arranged at a position closer to the second supporting part than the first supporting part; and the sheet feeding mechanism has a third supporting part configured to support the shaft at a position between the second supporting part and the contact member.

6. The sheet feeding mechanism according to claim 5, wherein the third supporting part has a restriction member configured to restrict displacement of the shaft in the longitudinal direction.

7. The sheet feeding mechanism according to claim 1, wherein a diameter of the first end of the shaft is smaller than a diameter of a portion of the shaft more toward the second end of the shaft.

8. The sheet feeding mechanism according to claim 1, further comprising a spring configured to apply an elastic force to the actuator to urge the contacting member to rock toward an upstream side in a sheet feed direction, the spring being also configured to apply an elastic force to urge the shaft to the inner circumferential surface of the first shaft hole.

9. The sheet feeding mechanism according to claim 1, wherein:

the first end portion of the shaft penetrates the first shaft hole; and the elastic supporting member, the first supporting part, the spring and the contact member are arranged from the first end side in this order.

10. An image forming apparatus, comprising:

an image forming unit configured to form an image on a sheet; and a sheet feeding mechanism provided at an inlet of the image forming apparatus and is configured to feed the sheet along a sheet feed path toward the image forming unit, the sheet feeding mechanism comprising:

an actuator having a contact member configured to contact a sheet within a contact area of the sheet feed path, and a shaft configured to support the contact member such that the contact member is rotatable about the shaft, the shaft having a first end and a second end in a longitudinal direction;

a first supporting part configured to support a first end portion of the shaft, wherein the first supporting part has a first shaft hole extending in a direction such that the first end of the shaft can move closer to or farther away from the sheet feed path, the first shaft hole having an end portion on a side closer to the sheet feed path;

a second supporting part configured to support a second end portion of the shaft, wherein the second supporting part has a second shaft hole in which the shaft can be fitted;

a detection unit configured to detect a position of the contact member; and an elastic supporting member configured to hold the first end portion of the shaft such that the shaft is displaceable in a direction perpendicular to the longitudinal direction;

wherein the elastic supporting member biases the first end portion of the shaft in a direction toward the contact area of the sheet feed path to contact the end portion of the first shaft hole.

11. The image forming apparatus according to claim 10, wherein:

the first shaft hole is formed to be an elongated hole; and the second shaft hole is formed to be a circular hole.

12. The image forming apparatus according to claim 10, wherein the elastic supporting member is made of porous material.

13. The image forming apparatus according to claim 10, wherein a portion of the elastic supporting member which contacts the shaft is provided with a coating layer formed of resin.

14. The image forming apparatus according to claim 10, wherein:

the detection unit is arranged at a position closer to the second supporting part than the first supporting part; and the sheet feeding mechanism has a third supporting part configured to support the shaft at a position between the second supporting part and the contact member.

15. The image forming apparatus according to claim 14, wherein the third supporting part has a restriction member configured to restrict displacement of the shaft in the longitudinal direction.

16. The image forming apparatus according to claim 10, wherein a diameter of the first end of the shaft is smaller than a diameter of a portion of the shaft more toward the second end of the shaft.

17. The image forming apparatus according to claim 10, wherein the sheet feeding mechanism further comprises a spring configured to apply an elastic force to the actuator to urge the contacting member to rock toward an upstream side in a sheet feed direction, the spring being also configured to apply an elastic force to urge the shaft to the inner circumferential surface of the first shaft hole.

18. The image forming apparatus according to claim 10, wherein:

the first end portion of the shaft penetrates the first shaft hole; and the elastic supporting member, the first supporting part, the spring and the contact member are arranged from the first end side in this order.

* * * * *